United States Patent [19]

Leigh

[11] Patent Number: 4,992,072

[45] Date of Patent: Feb. 12, 1991

[54] FLUTTERING TOY

[76] Inventor: William B. Leigh, 986 S. Main St., Cedar City, Utah 84720

[21] Appl. No.: 380,609

[22] Filed: Jul. 17, 1989

[51] Int. Cl.[5] ..... A63H 33/00

[52] U.S. Cl. ..... 446/486; 446/308; 446/489; 446/397

[58] Field of Search ..... 446/397, 308, 309, 311, 446/312, 491, 486, 35, 489, 418, 420

[56] References Cited

U.S. PATENT DOCUMENTS 3,501,861 3/1970 Goldfarb et al. ..... 273/428 X
4,155,195 5/1979 Leigh-Hunt ..... 446/35

FOREIGN PATENT DOCUMENTS 1347962 10/1987 U.S.S.R. ..... 446/486
992454 5/1965 United Kingdom ..... 446/486

*Primary Examiner*—Mickey Yu
*Attorney, Agent, or Firm*—Michael I. Kroll

[57] ABSTRACT

A self contained toy is disclosed. The toy includes a lower hollow hemisphere, an upper hollow hemisphere movably connected to the lower hollow hemisphere, and a crankshaft for causing the upper hollow hemisphere to move up and down relative to the lower hollow hemisphere so that the toy would jump.

7 Claims, 2 Drawing Sheets

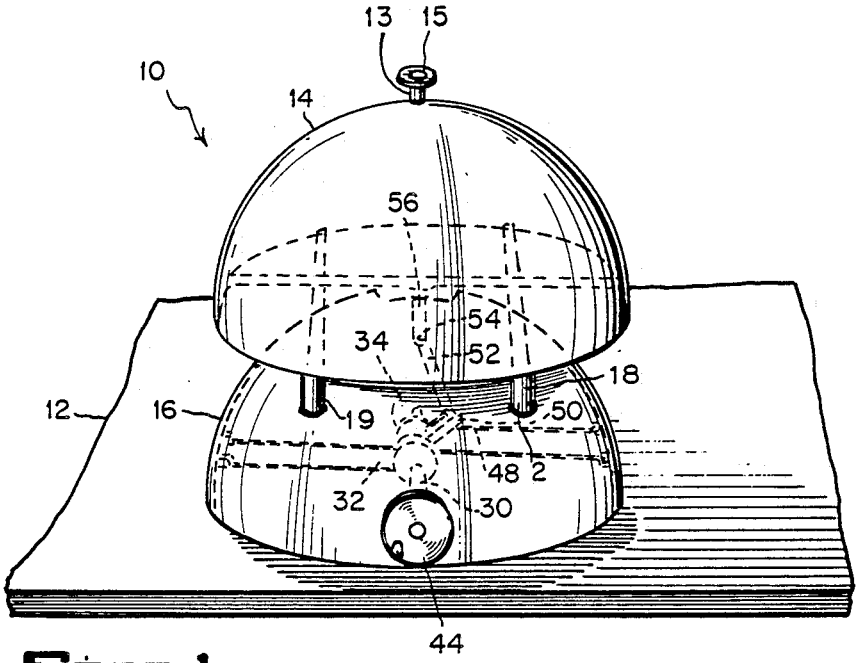
Fig. 1
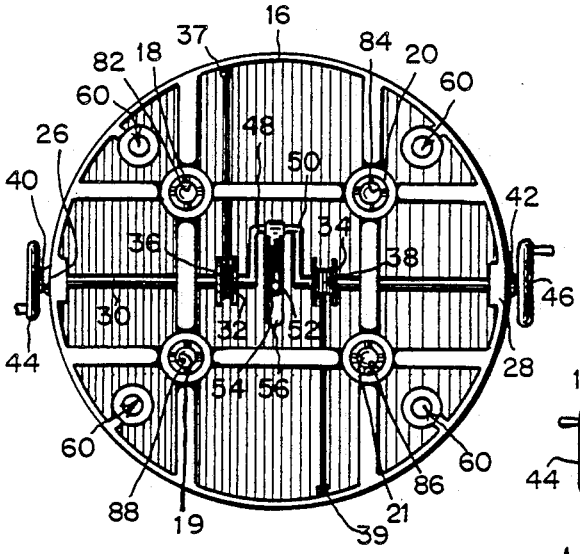
Fig. 3
Fig. 2
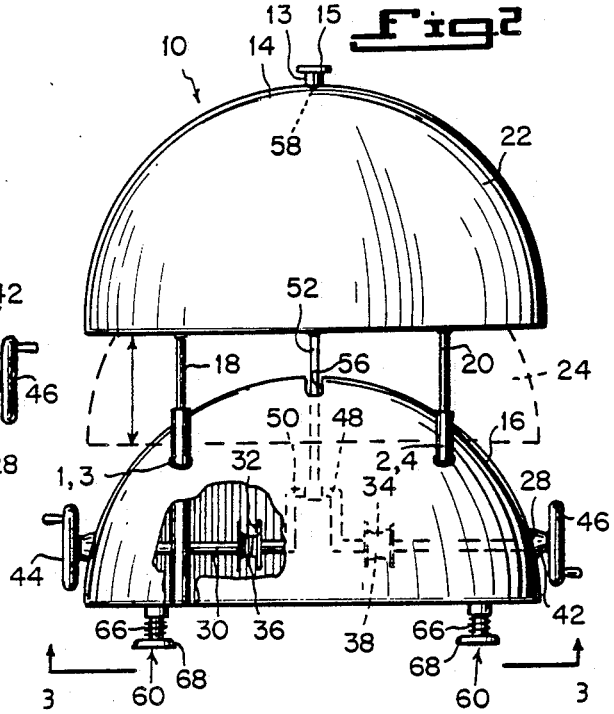

Fig. 4
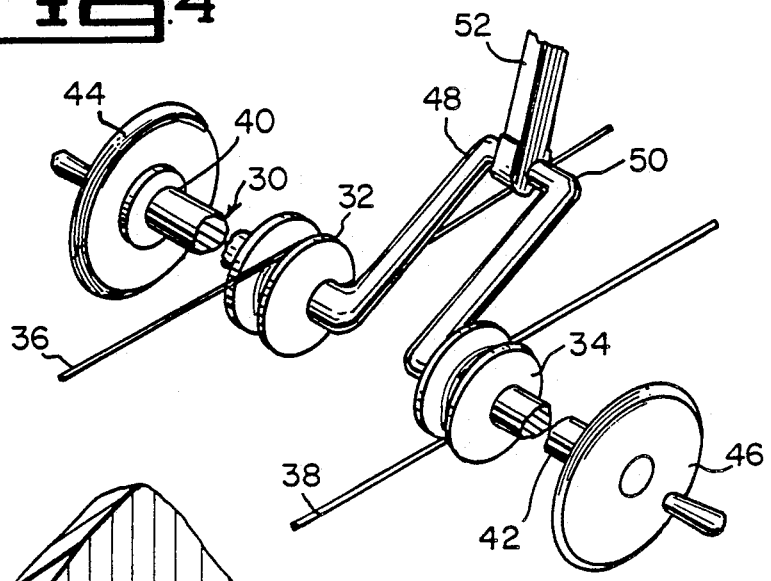
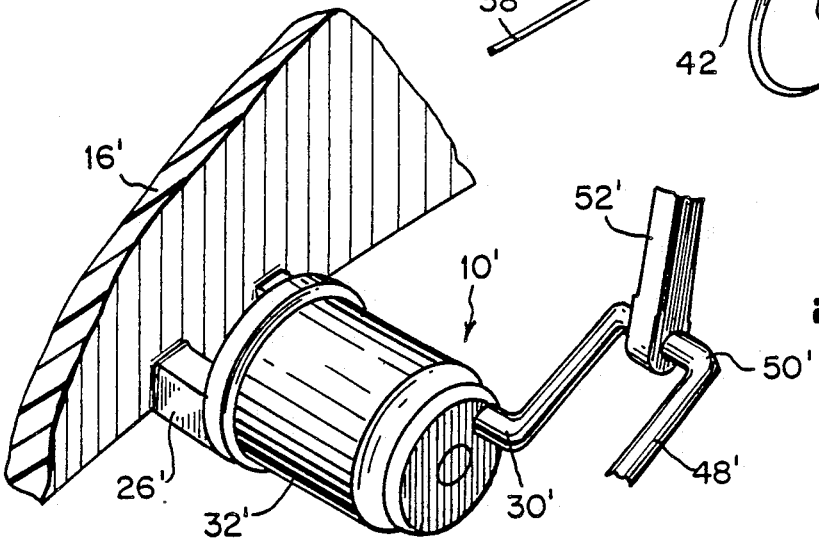
Fig. 5
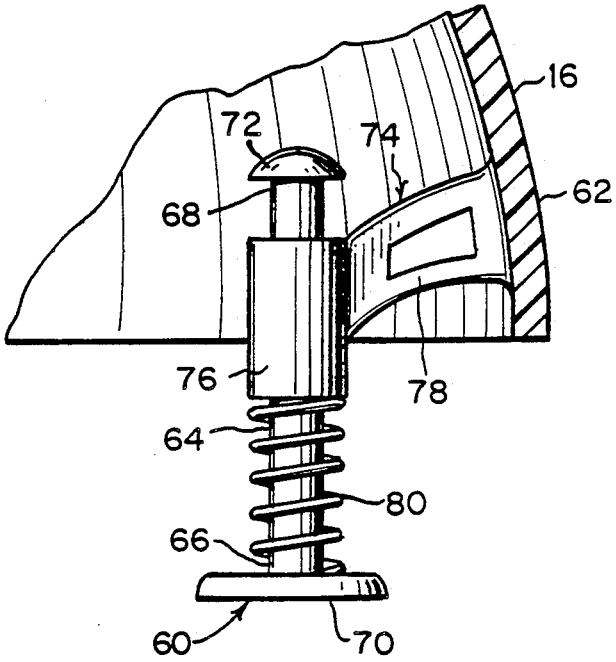
Fig. 6

FLUTTERING TOY

BACKGROUND OF THE INVENTION

Field of the Invention

The present invention relates to a toy.

More particularly, the present invention relates to a toy that can jump up and down on a support surface.

SUMMARY OF THE INVENTION

Accordingly, it is an object of the present invention to provide a toy that can jump up and down on a support surface.

More particularly, it is an object of the present invention to provide a toy that is fun to play with regardless of player's age.

In keeping with these objects, and with others which will become apparent hereinafter, one feature of the present invention resides, briefly stated, in a self contained toy that includes a lower hollow hemisphere, an upper hollow hemisphere movably connected to the lower hollow hemisphere wherein means are provided for causing the upper hollow hemisphere to move up and down relative to the lower hollow hemisphere.

In accordance with another feature of the present invention, the upper hollow hemisphere is movably connected to the lower hollow hemisphere by the use of four guide rods.

Another feature of the present invention is that the means include a crankshaft having an offset and being disposed in the lower hollow hemisphere.

Yet another feature of the present invention is that the crankshaft includes a connecting rod having a one end and another end and being movably connected at the one end to the upper hollow hemisphere and at the other end being movably connected to the offset of the crankshaft.

Still another feature of the present invention is that the crankshaft further comprises a pair of pulleys.

Yet still another feature of the present invention is that it further comprises a pair of rubbers so that they can be replaced easily if they snap and each having a one end fixedly attached to the lower hollow hemisphere and another end attached to the pulleys so that power is provided for rotating the crankshaft.

Still yet another feature of the present invention is that it further comprises a motor mounted to the lower hollow hemisphere and to the crankshaft so that power is provided for rotating the crankshaft.

Another feature of the present invention is that it further comprises a pluarlity of adjustable legs mounted to the lower hollow hemisphere so that the toy can be properly leveled.

The novel features which are considered characteristic for the invention are set forth in particular in the appended claims. The invention itself, however, both as to its construction and its method of operation, together with additional objects and advantages thereof, will be best understood from the following description of the specific embodiments when read in connection with the accompanying drawing.

BRIEF DESCRIPTION OF THE DRAWING

FIG. 1 is a perspective view of the toy of the present invention, in the up position;

FIG. 2 is a side view of the toy of the present invention shown rotated 90° from the position in FIG. 1 with parts cut away and phantomed;

FIG. 3 is a bottom view of the toy of the present invention, shown in FIGS. 1 and 2;

FIG. 4 is a perspective view of the crankshaft assembly of the toy of the present invention, shown in FIGS. 1 and 2;

FIG. 5 is a perspective view of an alternate embodiment of the toy of the present invention; and FIG. 6 is a side view of the adjustable legs of the toy of the present invention.

LIST OF REFERENCE NUMERALS UTILIZED IN THE DRAWING

10—toy of the present invention that can jump up and down on a support surface.
12—base/support surface on which the toy 10 that can jump up and down on a support surface is resting
13—handle for carrying the toy 10 that can jump up and down on a support surface.
14—an upper hollow hemisphere
15—hole carrying handle 13
16—lower hollow hemisphere
18—a guide rod
19—another guide rod
20—another guide rod
21—another guide rod
22—up position of the upper hollow hemisphere 14
24—down position of the upper hollow hemisphere 14
26—a journal aperture in the lower hollow hemisphere 16
28—another journal aperture in the lower hollow hemisphere 16
30—crankshaft supported in the lower hollow hemisphere 16
32—a pulley of crankshaft 30
34—another pulley of crankshaft 30
36—a rubber wound around the pulley 32
37—a fixed end of the rubber 36 wound around the pulley 34
38—another rubber wound around the pulley 34
39—another fixed end of the rubber band 38 wound around the pulley 36
40—an end of the crankshaft 30
42—another end of the crankshaft 30
44—a spoked rotatable wheel located at the end 40 of the crankshaft 30
46—another spoked rotatable wheel located at the end 42 of the crankshaft 30
48—single offset positioned at the center 50 of the crankshaft 30
50—center of the crankshaft 30
52—connecting rod connected to the single offset 48
54—free end of the connecting rod 52
56—elongated slot in the lower hollow hemisphere 16
58—center of the upper hollow hemisphere 14
60—leg assembly
62—point where the leg assembly 60 mounts to the lower hollow hemisphere 16
64—shaft of leg assembly 60
66—a free end of the shaft 64
68—another free end of the shaft 64
70—leveling plate of the leg assembly 60
72—slotted head 74—support of the leg assembly 60
76—hollow cylinder of the leg assembly 60
78—extension
80—spring of the leg assembly 60
82—a sleeve for receiving the guide rod 18
84—another sleeve for receiving another guide rod 20
86—another sleeve for receiving another guide rod 22
88—another sleeve for receiving another guide rod 24
10'—alternate embodiment of the present invention that can jump up and down on a support surface.
16'—alternate embodiment of the lower hollow hemisphere
26'—mount of the alternate embodiment
30'—crankshaft of the alternate embodiment
32'—motor to power the crankshaft
48'—single offset of the crankshaft
50'—center of the single offset 48'
52'—connecting rod

DETAILED DESCRIPTION OF THE PREFERRED EMBODIMENT

Referring now to FIGS. 1 and 2, the toy of the present invention that can jump up and down on a support surface is shown generally at 10, resting on a base/support surface 12, and including a carrying handle 13. The carrying handle 13 contains a hole 15, and may be made of hard rubber, but it is not limited to it.

The toy 10 of the present invention that can jump up and down on a support surface includes an upper hollow hemisphere 14 and a lower hollow hemisphere 16.

The upper hollow hemisphere 14 is connected to the lower hollow hemisphere 16 by four guide rods 18, 19, 20, and 21. The upper hollow hemisphere 14 assumes two positions, an up position 22, and a down position 24, shown in phantom in FIG. 2. A part of each of the hollow dampers 18, 19, 20, and 21 pass through the hollow lower hemisphere 16 yet still remain opened from end to end. The four guide rods 18, 19, 20, and 21 are made of plastic but are not limited to it. The lower hollow hemisphere 16 contains a pair of journal apertures 26 and 28. The journal apertures 26 and 28 support a crank shaft 30, as shown in FIGS. 1 to 4.

The bottom of the lower hollow hemisphere 14, shown in FIG. 3, contains four apertures 82, 84, 86, and 88, sufficiently supported by a network of cross ribs. For strength and stability, the ends of the sleeves 18, 19, 20, and 21 are, respectively, secured within the four apertures 82, 84, 86, and 88 of the bottom of the lower hollow hemisphere 14.

The crankshaft 30 includes a pair of pulleys 32 and 34 around which are wound a pair of rubber 36 and 38, respectively. At the ends 40 and 42 of the crankshaft 30, are located a pair of rotatable wheels 44 and 46, respectively.

A single offset 48 is positioned at the center 50 of the crankshaft 30. Rotatably connected to the single offset 48, is a connecting rod 52 whose free end 54 passes through an elongated slot 56 in the lower hollow hemisphere 16 and is pivotally connected at the center 58 of the upper hollow hemisphere 14.

A plurality of leg assemblies 60, shown in FIGS. 2 and 6, are mounted to the interior of the lower hollow hemisphere 16 at points 62. The leg assembly 60 includes a shaft 64 having a pair of free ends 66 and 68. The free end 66 is attached to a leveling plate 70, while the free end 68 has a slotted head 72. A support 74 has two portions, a hollow cylindrical portion 76 and an extension portion 78. A spring 80 located between the leveling plate 70 and the hollow cylinder portion 76, bias the leg assembly 60 to an extended position while the shaft 64 is rotated so that the toy 10 can be leveled.

FIG. 5 shows an alternate embodiment of the present invention, designated as 10'. The crankshaft 30' has a motor 32' mounted to the lower hollow hemisphere 16' through a mount 26'. The single offset 48' performs the same function as that of connecting rod 52' connects to the offset 48' at the center 50' of the offset 48'.

In operation, the toy 10 is first leveled by the use of the leg assemblies 60. Once the toy 10 is leveled, the spoked rotatable wheel 44 or 46 is cranked. Since the crankshaft 30 is continuous, the pulleys 32 and 34 rotate with the crankshaft 30 when the rotatable wheel 44 or 46 is cranked. This causes the rubbers 36, 38 to wind up.

A fixed end 37 of the rubber 36 is attached to the lower hollow hemisphere 16 while the other end of the rubber 36 is attached to the pulley 32 when the spoked rotatable wheel 44 or 46 is cranked. The other fixed end 39, of the rubber 38 is also attached to the lower hollow hemisphere 16 while the other fixed end of the rubber band 38 is attached to the pulley 34 when the spoked rotatable wheel 44 or 46 is cranked.

When the spoked rotatable wheel 44 or 46 is released, the rubber 36 and 38 begin to unwind from the pulleys 32 and 34, respectively, and give up their stored energy to power the crankshaft 30. The rotating crankshaft 30 causes the connecting rod 52 to move up and down. Since the connecting rod 52 is attached to the interior of the upper hollow hemisphere 14, as the connecting rod 52 moves up and down, so does the upper hollow hemisphere 14. When the toy 10 of the present invention can jump up and down on a support surface, the bottom hemisphere 16 moves up and down and moves in the manner of an accordian, and bouncing the toy 10 of the present invention.

It will be understood that each of the elements described above, or two or more together, may also find a useful application in other types of constructions differing from the type described above.

While the invention has been illustrated and described as embodied in a toy that can jump up and down on a support surface, it is not intended to be limited to the details shown, since it will be understood that various omissions, modifications, subsutitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

I claim:

1. A self contained toy that can jump up and down on a support surface, comprising:

(a) a lower hollow hemisphere;

(b) an upper hollow hemisphere movably connected to said lower hollow hemisphere; and (c) means for causing said upper hollow hemisphere to jump up and down relative to said lower hollow hemisphere on said support surface.

2. The toy as defined in claim 1, wherein said upper hollow hemisphere is movably connected to said lower hollow hemisphere by the use of four guide rods.

3. The toy as defined in claim 2, wherein said means include a crankshaft having an offset and being disposed in said lower hollow hemisphere.

4. The toy as defined in claim 3, wherein said crankshaft includes a connecting rod having a one end and another end and being movably connected at said one end to said upper hollow hemisphere and said other end being movably connected to said offset of said crankshaft.

5. The toy as defined in claim 4, wherein said crankshaft further includes a pair of pulleys.

6. The toy as defined in claim 5; further comprising a pair of rubbers each having a first end fixedly attached to said lower hollow hemisphere and a second end fixedly attached to said pulleys so that energy is provided for rotating said crankshaft.

7. The toy as defined in claim 1; further comprising a plurality of adjustable legs mounted to said lower hollow hemisphere so that the toy can be properly leveled.

* * * * *